United States Patent [19]

Raschbichler

[11] 4,454,820

[45] Jun. 19, 1984

[54] APPARATUS FOR DAMPING OSCILLATIONS OF MAGNETIC ELEVATED TRACKS AND VEHICLES FLOATINGLY SUSPENDED THEREON

[75] Inventor: Hans-Georg Raschbichler, Ottobrunn, Fed. Rep. of Germany

[73] Assignee: Thyssen Industrie Aktiengesellschaft, Essen, Fed. Rep. of Germany

[21] Appl. No.: 296,489

[22] Filed: Aug. 26, 1981

[30] Foreign Application Priority Data

Mar. 26, 1981 [DE] Fed. Rep. of Germany ... 8108814[U]

[51] Int. Cl.[3] ..... B61B 13/08

[52] U.S. Cl. ..... 104/281; 104/284; 248/559; 248/636

[58] Field of Search ..... 238/1, 382; 104/281, 104/284; 248/559, 610, 636; 104/282; 105/452

[56] References Cited

U.S. PATENT DOCUMENTS

| | | | |
|---|---|---|---|
| 3,871,301 | 3/1975 | Kolm et al. | 104/282 X |
| 4,203,546 | 5/1980 | Raquet et al. | 238/382 |

FOREIGN PATENT DOCUMENTS

| | | | |
|---|---|---|---|
| 17270 | 10/1980 | European Pat. Off. | 248/559 |
| 2152393 | 4/1973 | Fed. Rep. of Germany | 104/282 |
| 321783 | 7/1957 | Switzerland | 238/382 |
| 726270 | 4/1980 | U.S.S.R. | 248/636 |

*Primary Examiner*—Robert B. Reeves
*Assistant Examiner*—David F. Hubbuch
*Attorney, Agent, or Firm*—Becker & Becker, Inc.

[57] ABSTRACT

An apparatus for damping mechanical oscillations vibrations or pulstations with magnetic suspension railways having vehicles movable to float along elevated tracks using magnetic levitation or suspension technique as well as having supplemental suppression device suppression devices to eliminate oscillation. Each supplemental oscillation suppression device has an additional mass in the form of a hollow body or solid material, and is suspended by means of steel or rubber springs on the longitudinal vehicle support or on the longitudinal track beam. One end face of that supplemental oscillation suppression device associated with the vehicle is provided with a buffer in the horizontal plane of the longitudinal axis thereof, and respective stops are arranged on both longitudinal sides and are fastened to the longitudinal support, with the end face of the hollow body facing the buffer being closed by a base plate, the opposite end face being tightly closable with a screw cap. That supplemental oscillation suppression device associated with the track is fastened in a free-swinging manner within the box profile of the longitudinal track beam and on the top chord thereof. The web plates are provided with openings for inserting the supplemental oscillation suppression device.

6 Claims, 5 Drawing Figures

II
II
1
2
2
5
6
7
8
9
10
12
10'
11
3
5
4
10
14
9
13
22
8
5
21
1

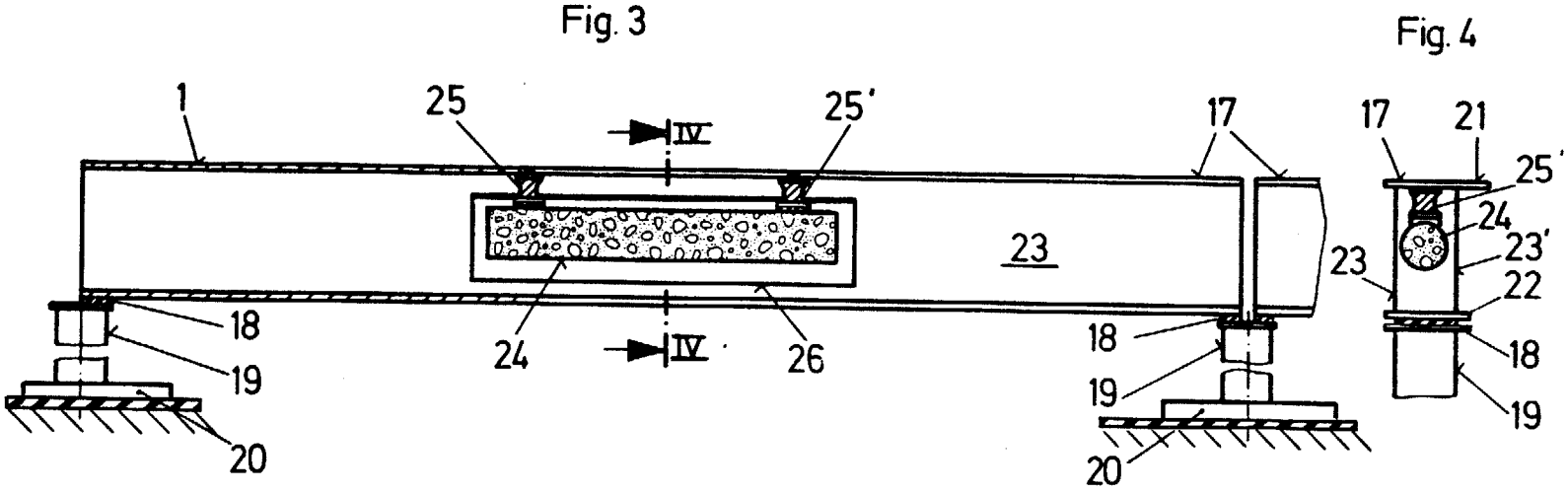
Fig. 4
21
17
25'
24
23'
22
18
19
23
Fig. 3
17
23
25'
26
IV
IV
24
25
1
18
19
20
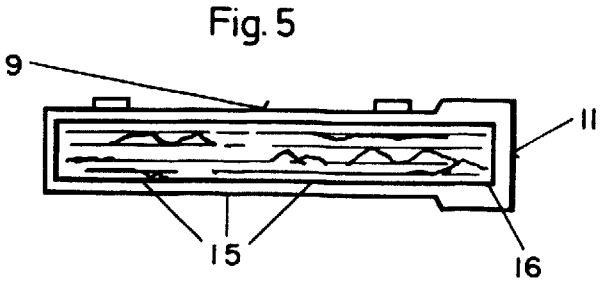
Fig. 5
11
16
15
9

APPARATUS FOR DAMPING OSCILLATIONS OF MAGNETIC ELEVATED TRACKS AND VEHICLES FLOATINGLY SUSPENDED THEREON

The present invention relates to an apparatus or oscillation suppression device for damping mechanical oscillations of magnetic elevated tracks and vehicles floatingly suspended thereon.

It is known in vehicle construction, for damping mechanical oscillations, to use, for instance, undamped supplemental device, so-called "tilger" means or eliminators, which suppress the oscillations at their bases by neutralizing the excitation forces which act at these locations by means of their mass or inertial forces (Handbook for Motor Vehicle Engineers, Seventh Edition, 1963, DVA, Stuttgart, Page 614).

In the magnetic suspension (i.e. floating or hovering) technology, the amplitudes of the oscillations, which arise on the vehicles and transfer to the longitudinal supports or beams of the elevated tracks, are measured by sensors and emitters and are supplied to a control circuit, where they are amplified by superimposed signals and lead to malfunctions of the control, which is noticeable in so-called boundary effects.

The oscillation problems in the magnetic suspension technology have previously been resolved by special control concepts with special switches for eliminating a particular frequency, and by filter means installed in the control circuit. These measures, however, impair the control circuit quality, and consequently the dynamic behavior of the magnetically suspended vehicle. Additionally, only a small number of exciter frequencies can be eliminated. With the tracks, the resonance oscillations in the longitudinal track beams are reduced or suppressed by mechanical damping devices. For this purpose, either special supports are provided between the longitudinal track beams and supports, or an additional support in the middle of the longitudinal track beam is arranged between two respective track supports.

With the first mentioned embodiment, it is disadvantageous that practically only one excitation frequency, or the resonance amplitude thereof, can be reduced. Additionally the special supports between the longitudinal track beams and supports are very expensive and consequently very uneconomical with respect to the track investment. Also, the prevailing track gauge or span width is changed by the middle support, and the through-passage below the longitudinal track beam is narrowed or restricted.

Consequently, it is an object of the present invention to provide an apparatus or oscillation suppression device of the initially mentioned type with which, regardless of the structural conditions, a complete suppression of the oscillations is effected.

This object, and other objects and advantages of the present invention, will appear more clearly from the following specification in connection with the accompanying drawings, in which:

FIG. 3 is a side view of an elevated longitudinal track support having a supplemental oscillation suppression device made of solid material;

FIG. 4 is a section taken along line IV—IV in FIG. 3; and

FIG. 5 shows in detail a supplemental oscillation suppression device embodied as a hollow body for liquid damping medium.

Figures 1, 2:
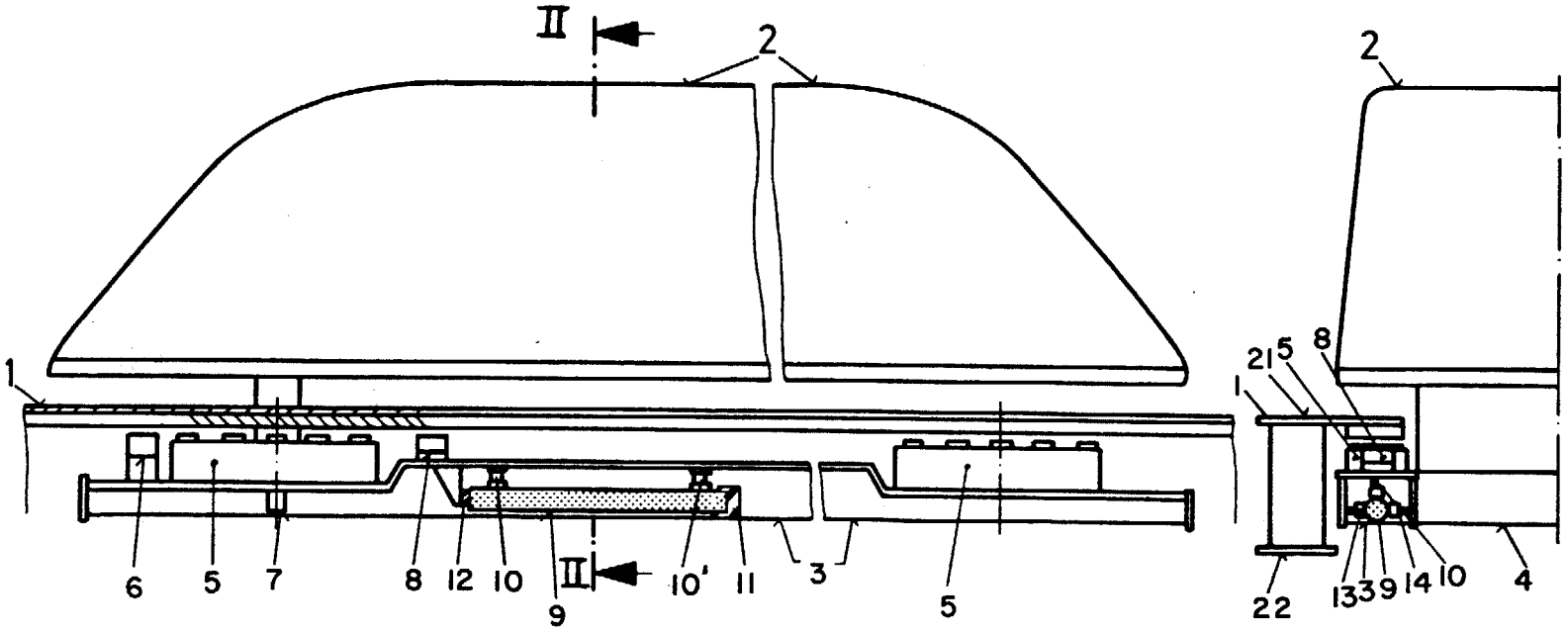
FIG. 1 is a side view of a longitudinal track beam or support with a magnetically suspended or floating vehicle, whereby the supplemental oscillation suppression device, which is embodied as a hollow body, is shown in a longitudinal middle section.
FIG. 2 is a half section taken along line II—II in FIG. 1, with only the parts essential for the present invention being illustrated.

The apparatus of the present invention is characterized primarily in that each supplemental oscillation suppression device has an additional mass (hollow body or solid material) and is suspended by means of steel or rubber springs on the longitudinal vehicle support or on the longitudinal track beam; one end face of that supplemental oscillation suppression device associated with the vehicle is provided with a buffer in the horizontal plane of the longitudinal axis thereof, and respective stops are arranged on both longitudinal sides and are fastened to the longitudinal support, with that end face of the hollow body facing the buffer being closed off by a base plate, the opposite end face being tightly sealable by a screw cap; furthermore, that supplemental oscillation suppression device associated with the track is fastened in a free-swinging manner within the box profile of the longitudinal track beam and on the top chord thereof; and the web elements or crosspiece plates are provided with openings for inserting the supplemental oscillation suppression device.

The supplemental oscillation suppression device associated with the vehicle and embodied as a hollow body for receiving granular or liquid damping medium may also be provided with a closable feed or filling opening.

The volume of the granular or liquid damping medium in the hollow body of the supplemental oscillation suppression device may be varied. Splash walls may be arranged in the hollow body of the supplemental oscillation suppression device for the liquid damping medium.

Referring now to the drawings in detail for an illustrated embodiment, the chassis of the magnetically suspended, vehicle 2, which is located to hover or float on an elevated way or track 1, comprises two longitudinal beams or supports 3, which in cross section have a U-shaped, downwardly open profile, and the ends of which are connected with each other and to a frame by means of two transverse supports or beams 4. Support and guide magnets 5 as well as sensors and emitters 6, 7, and 8 are respectively arranged on the ends of the longitudinal vehicle supports 3 both for measuring the gap between the magnets, and for measuring the acceleration of the vehicle. Additionally, approximately in the middle of the longitudinal vehicle support 3, which is easily caused to oscillate by the magnet control circuit, there is located a supplemental oscillation suppression device 9 having an elastic mass in the form of a sealable hollow body, which is suspended on the crosspiece of the longitudinal vehicle support by means of two steel or rubber springs 10 and 10'. One end face of the hollow body is closed off by a base plate (not illustrated in greater detail), and the other end face of the hollow body is tightly sealable by means of a screw cap 11. A buffer 12, which is fastened to the crosspiece of the longitudinal vehicle support, is located on that end face of the supplemental oscillation suppression device 9 provided with the base plate. On both longitudinal sides of the supplemental oscillation suppression device 9, there is respectively provided a stop 13, 14, each of which is rigidly connected with a vertical leg of the longitudinal vehicle support. By means of the buffer 12, the supplemental oscillation suppression device 9, during deceleration of the vehicle, does not carry out any undue movement in the direction of travel, and the two stops 13 and 14 preclude movement of the supplemental oscillation suppression device 9 toward the side.

The hollow body in the supplemental oscillation suppression device 9 has a sealable feed or filling opening, and can be filled either with granular or liquid damping medium, for instance oil. When liquid damping medium is used, splash walls 15 extending in the longitudinal direction are installed in the hollow body (FIG. 5), and the screw cap 11 is provided with a sealing ring 16. A damping of the supplemental oscillation suppression device associated with the vehicle is attained by the internal friction of the granular and liquid filler, the volume of which can be changed.

In the embodiment of FIG. 3, the raised track 1 is formed of several sequentially arranged longitudinal beams or supports 17, the support or contact areas of which rest or are supported on supports 19, with adjustable supports 18 interposed therebetween. These supports 19 in turn are supported on a concrete foundation 20. The longitudinal track beam 17 has a box profile with a top chord or run 21, and a bottom chord 22, which are connected with each other to form a unit by two vertical web elements or crosspiece plates 23, 23' arranged at a distance from one another. A supplemental oscillation suppression device 24 having an additional mass of solid material, for instance concrete, is suspended, likewise by means of steel or rubber springs 25, 25', on the top chord 21 in the longitudinal middle of the track beam 17 and in the transverse middle of the box profile. This supplemental oscillation suppression device 24 is arranged so as to swing freely in the interior of the longitudinal track beam 17. The crosspiece plates 23, 23' are provided with openings 26 to introduce or insert the supplemental oscillation suppression device 24, which is made of solid material, into the box profile of the longitudinal track beam 17.

The described apparatus is arranged in the same manner on the other longitudinal side of the vehicle magnetically suspended to float along the track.

The present invention is, of course, in no way restricted to the specific disclosure of the specification and drawings, but also encompasses any modifications within the scope of the appended claims.

What I claim is:

1. In a transportation system including (a) a vehicle; (b) a longitudinally extending beam on which is located a longitudinally extending armature forming a track for supporting the vehicle, and (c) magnetic means for supporting the vehicle in a magnetic field in spaced relation to the track; a support on the vehicle which extends parallel to the longitudinally extending beam of the track, the longitudinally extending beam having a pair of spaced, vertically extending web plates supporting a horizontally extending chord plate upon which the horizontally oriented and longitudinally extending armature is located; the improvement characterized by apparatus for damping mechanical oscillations, which apparatus comprises in combination:

a first oscillation suppression device, the device being a hollow longitudinally extending body having two end faces, two longitudinally extending side portions, a top portion and a bottom portion, the hollow body being filled with a damping medium;

spring means connected between the hollow body and longitudinally extending support for suspending the body on the vehicle;

a stop on the longitudinally extending support adjacent to one of the end faces of the hollow body;

a buffer between said end face and the stop;

means engaging the side portions of the hollow body to minimize lateral movement thereof while permitting longitudinal movement thereof with respect to said stop;

means for selectively closing the other end face to leave the hollow body accessable for adjustments to the damping medium;

second oscillation suppression devices, the second oscillation suppression devices being longitudinally extending, solid bodies; and spring means connecting the solid bodies to the chord plate at a location between the vertically extending web plates for free swinging movement with respect thereto; whereby mechanical oscillations which might occur in the system are damped.

2. The apparatus of claim 1 wherein the damping medium is a liquid.

3. The apparatus of claim 2 wherein the amount of liquid may be varied.

4. The apparatus of claim 2 wherein the hollow body includes a plurality of spaced splash walls.

5. The apparatus of claim 1 wherein the damping medium is a granular solid.

6. The apparatus of claim 5 wherein the amount of granular solid used may be varied.

* * * * *